US005125454A

United States Patent [19]

Creamer et al.

[11] Patent Number: 5,125,454

[45] Date of Patent: Jun. 30, 1992

[54] MANIFOLD ASSEMBLY FOR A PARALLEL FLOW HEAT EXCHANGER

[75] Inventors: Harvey Creamer, Montgomery; Donald W. Mathews, Georgiana; Peter M. Watson, Montgomery; Lionel J. LeJeune, III, Wetumpka, all of Ala.

[73] Assignee: Thermal Components, Inc., Montgomery, Ala.

[21] Appl. No.: 750,198

[22] Filed: Aug. 27, 1991

[51] Int. Cl.[5] ..... F28F 9/02

[52] U.S. Cl. ..... 165/173; 165/153; 165/149; 29/890.052

[58] Field of Search ..... 165/152, 153, 173, 174, 165/149; 29/890.052, 890.08

[56] References Cited

U.S. PATENT DOCUMENTS

| | | | |
|---|---|---|---|
| 3,866,675 | 2/1975 | Bardon et al. | 165/173 |
| 3,960,208 | 6/1976 | Anthony et al. | 165/1 |
| 4,455,728 | 6/1984 | Hesse | 29/890.052 |
| 4,531,578 | 7/1985 | Stay et al. | 165/175 |
| 4,600,051 | 7/1986 | Wehrman | 165/149 |
| 4,615,952 | 10/1986 | Knoll | 428/650 |
| 4,825,941 | 5/1989 | Hoshino et al. | 165/110 |
| 4,877,083 | 10/1989 | Saperstein | 165/176 |
| 4,936,381 | 6/1990 | Alley | 165/176 |
| 4,938,284 | 7/1990 | Howells | 165/149 |
| 4,945,635 | 8/1990 | Nobusue et al. | 29/890.043 |
| 5,036,914 | 8/1991 | Nishishita et al. | 165/173 |
| 5,069,277 | 12/1991 | Nakamura et al. | 165/173 |

FOREIGN PATENT DOCUMENTS

| | | | |
|---|---|---|---|
| 60-33497 | 2/1985 | Japan | 29/890.052 |
| 2-224836 | 9/1990 | Japan | 29/890.052 |
| 944094 | 12/1963 | United Kingdom | 29/890.052 |
| 2049149A | 12/1980 | United Kingdom | 165/173 |
| 2082312A | 3/1982 | United Kingdom | 165/173 |
| 2090652A | 7/1982 | United Kingdom . | |

*Primary Examiner*—Allen J. Flanigan
*Attorney, Agent, or Firm*—Mason, Fenwick & Lawrence

[57] ABSTRACT

A manifold assembly for use with heat exchangers comprises a unitary tank having a semicircular cross-section and a unitary header plate which also has a semi-circular cross-section, the outer diameter of the tank being substantially equal to the inner diameter of the header plate to allow the tank to be inserted into the header plate. A plurality of transverse tube holes are formed through the header plate along its longitudinal center line for receiving the tubes of the condenser or evaporator. A flange or lip is formed around the tube holes to provide both a tube lead-in and a joint filleting pocket. A plurality of opposed transverse slots are formed through the tank and header plate along their longitudinal center lines to receive baffles therein for locking the tank and header plate together during assembly and for adjusting the flow pattern during use. The baffles are configured to engage the inner walls and sides of the slots. The tank, header plate, and baffles are formed of aluminum and aluminum alloy materials suitable for furnace brazing. A bracket or tabs for securing a bracket can be formed unitarily with the header plate.

9 Claims, 2 Drawing Sheets

MANIFOLD ASSEMBLY FOR A PARALLEL FLOW HEAT EXCHANGER

BACKGROUND OF THE INVENTION

The present invention is directed to the field of manifold assemblies for use with heat exchangers, particularly heat exchangers for refrigeration applications.

Heat exchangers for refrigeration applications, particularly condensers and evaporators, are subjected to relatively high internal refrigerant pressure. Further, such heat exchangers cannot allow any leakage of refrigerant into the atmosphere and therefore preferably are designed with as few manufacturing connections as possible. Where manufacturing connections are necessary, their joints must be able to be manufactured economically and with a high probability that they will not leak.

Automotive condensers have typically been constructed with a single length of refrigerant tube, assembled in a serpentine configuration with an inlet at one end and an outlet at the other end. In some cases, two or more of such serpentine coils are assembled into an intertwined configuration so as to provide a multiple path flow of refrigerant across the air flow. The ends of the separate serpentine coils are connected to common manifolds. This concept of multiple path flow is extended to what is called a "parallel flow heat exchanger," in which all refrigerant tubes are straight and parallel to each other with the individual ends of these tubes connected to respective inlet and outlet manifolds. This configuration is commonly utilized in the construction of engine cooling radiators, oil coolers, and more recently, air conditioning condensers.

Condenser application to parallel flow has been more difficult to achieve in practice because of the need for multiple high pressure joints. Also, the atmospheric problems associated with release of standard refrigerants has necessitated the change to newer, more chlorinated refrigerants such as R-134A. The R-134A refrigerant is not as efficient as R-12 refrigerants, and also operates at higher pressure than R-12 refrigerants. The lower efficiency of the R-134A refrigerant requires a condenser design which not only is more efficient, such as a parallel flow design, but also is able to withstand higher internal operating pressures.

Manifolding multiple tubes to withstand high internal pressure can best be accomplished with a tubular manifold, the cross-section of which is circular for highest strength, as shown in FIG. 1. U.S. Pat. No. 4,825,941 Hoshino et al. is an example of such a manifold with a circular cross-section. The chief disadvantage to the tubular manifold with a circular cross-section is the difficulty of piercing the series of holes in each manifold to receive the multiple parallel refrigerant tubes. Also, the tubular manifold with circular cross-section presents difficulties in assembly during manufacture. One partial solution to these problems is to flatten one side of each manifold tube as shown in FIG. 2, so as to provide a D-shaped cross-section which can more easily be pierced and subsequently assembled. However, insertion of the tubes into the manifold is still difficult. Also, in some heat exchanger designs, it is necessary to insert baffles in each manifold to create a multiple pass refrigerant flow. Insertion of the baffles into a tubular manifold can also present difficulties in assembly during manufacture.

Accordingly, it has been proposed to use a two-piece manifold comprising a tank and a header plate. In one such construction, shown in FIG. 2 of U.S. Pat. No. 4,938,284to Howells, the tank is formed with inwardly facing grooves and the tank is slid into engagement with the header plate, which is planar. As shown in FIG. 5 of the Howells patent, the tank can alternatively be formed with inwardly curved side wall members and the header plate can be formed with upturned longitudinal edges for gripping engagement with the side wall members of the tank when the tank is slid into engagement with the header plate. In both constructions, the tank is coated before assembly with a brazing material and flux to enable it to be secured upon assembly to the header plate.

Although the constructions shown in the Howells patent provide both a mechanical and metallalurgical bond between the tank and header plate, sufficient clearance must be provided between the tank and the header plate to permit sliding of the one onto the other. This clearance prevents the good fit required for effective brazing. Further, it is often desirable to provide baffles in the assembled tank and header plate to adjust the flow path. When the tank and header plate are assembled by sliding, it is difficult, if not impossible, to place baffles between them prior to assembly.

In another construction, the tank is provided with a flange, tabs are placed on the header plate, a gasket is inserted between the header plate and the tank, and the tabs are crimped over the tank flange. Examples of such a construction are shown in U.S. Pat. No. 4,455,728to Hesse, U.S. Pat. No. 4,531,578 to Stay et al., and U.S. Pat. No. 4,600,051to Wehrman. A leakproof-type seal is provided by compressing the gasket. However, compression of the gasket is not sufficient to seal the header plate and tank under the high pressures found in condensers.

A solution to these problems was proposed in copending U.S. application Ser. No. 503,798 of Calleson, which is expressly incorporated herein by reference. In the Calleson application, a pair of opposed parallel shelves are formed in the inner wall of the tank inwardly of the bottom edges to define a pair of flanges extending from the shelves. The shelves in the tank form stops against which the header plate abuts. The tank flanges are crimped inwardly to engage at least a portion of the edge portions of the header plate along the entire length of the header plate. Also, the tank and header plate are brazed together along substantially the entire lengths of their mating surfaces in order to provide both a mechanical and a metallurgical bond which provides the strengths to withstand high internal pressures. A pair of opposed, longitudinally-extending horizontal ribs can be formed in the inner wall of the tank and provided with opposed slots to receive baffles, in order to adjust the flow pattern. The horizontal ribs can also serve as tube stops.

Although the crimped flange proposed in the Calleson application is superior to the prior art flange and tab configurations, the crimping of the flange around the header plate prevents the filler material or alloy from flowing well enough to provide as uniform or consistent a brazed joint or fillet as is ideally desired for high pressure applications. It is the solution of the above and other problems to which the present invention is directed.

SUMMARY OF THE INVENTION

Therefore, it is a primary object of this invention to provide a manifold assembly for heat exchangers which can withstand high internal operating pressures.

It is another object of this invention to provide a manifold assembly for heat exchangers which employs an exceptionally strong and uniform metallurgical bond between the tank and header plate.

It is still another object of the invention to provide a manifold assembly for heat exchangers which is easier and less costly to assemble.

These and other objects of the invention are achieved by the provision of a manifold assembly which comprises a unitary tank having a semicircular cross-section and a unitary header plate which also has a semi-circular cross-section, the outer diameter of the tank being substantially equal to the inner diameter of the header plate to allow the tank to be inserted into the header plate.

The tank comprises an inner wall, an outer wall, and a pair of bottom edges intermediate the inner and outer walls. The header plate comprises an inner wall, an outer wall, and a pair of upper edges intermediate the inner and outer walls. A plurality of transverse tube holes are formed through the header plate along its longitudinal center line for receiving the tubes of the condenser or evaporator. Preferably, a flange or lip is formed around the tube holes to provide both a tube lead-in and a joint filleting pocket.

In one aspect of the invention, a plurality of opposed transverse slots are formed through the tank and header plate along their longitudinal center lines to receive baffles therein for locking the tank and header plate together during assembly and for adjusting the flow pattern during use. The baffles are configured to engage the inner walls and sides of the slots, and are also formed of aluminum and aluminum alloy materials suitable for furnace brazing, so that when the manifold assembly is brazed in a high temperature brazing furnace, the baffles are brazed to the tank and the header plate.

In another aspect of the invention, the tank is formed by extrusion and the header plate is formed by stamping. Both are formed of aluminum and aluminum alloy materials suitable for furnace brazing, at least one of the mating surfaces being fabricated with a lower temperature clad brazing material, so that when the tank, header plate, and tubes are assembled, fixtured, and brazed in a high temperature brazing furnace, the clad material provides the brazed material to braze the tubes to the header plate and the header plate to the tank.

In still another aspect of the invention, the header plate is formed by forming or stamping from clad aluminum brazing sheet. The tank is formed by forming or stamping from aluminum brazing sheet which may or may not be clad.

The baffles are also formed of aluminum and aluminum alloy materials suitable for furnace brazing, so that when the manifold assembly is brazed in a high temperature brazing furnace, the baffles are brazed to the tank and the header plate.

In still another aspect of the invention, a bracket or tabs for securing a bracket can be formed unitarily with the header plate.

A better understanding of the disclosed embodiments of the invention will be achieved when the accompanying detailed description is considered in conjunction with the appended drawings, in which like reference numerals are used for the same parts a illustrated in the different Figures.

DETAILED DESCRIPTION OF THE PREFERRED EMBODIMENTS

Figure 1:
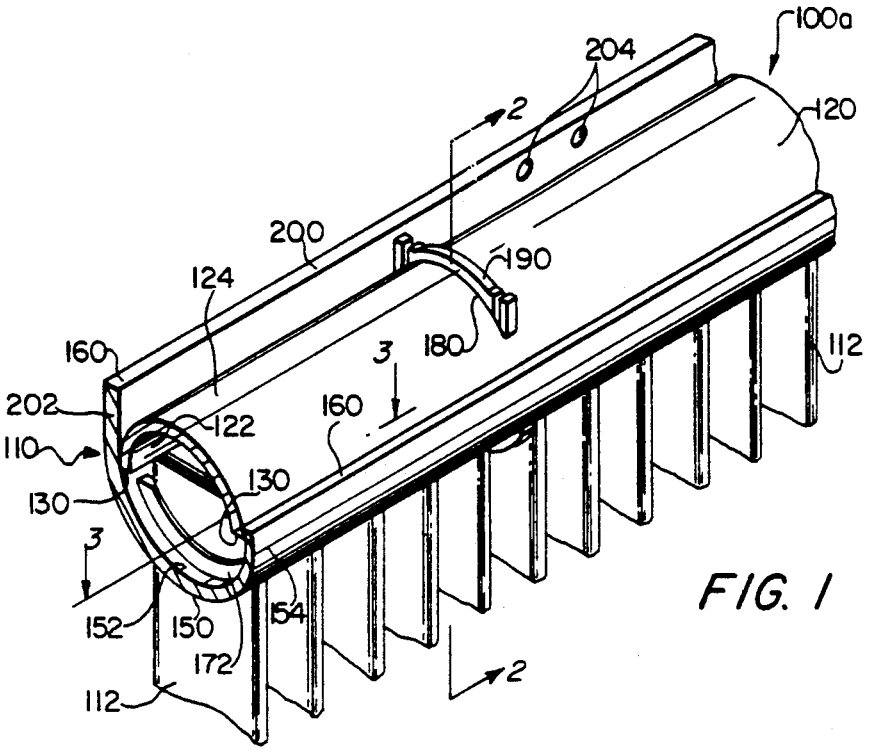
FIG. 1 is a perspective view, partially cut away, of a manifold and heat exchanger assembly in accordance with a first embodiment of the present invention.
Figure 2:
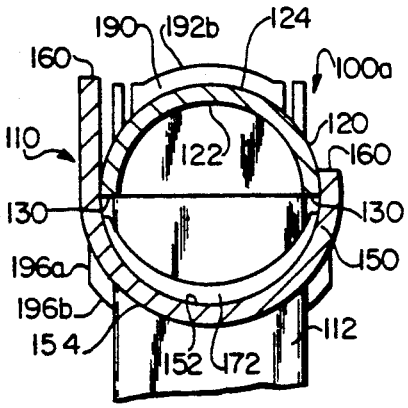
FIG. 2 is a cross-sectional view of the manifold and heat exchanger assembly of FIG. 1, taken along line 2—2 of FIG. 1.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalence which operate in a similar manner to accomplish a similar purpose.

Figure 7:
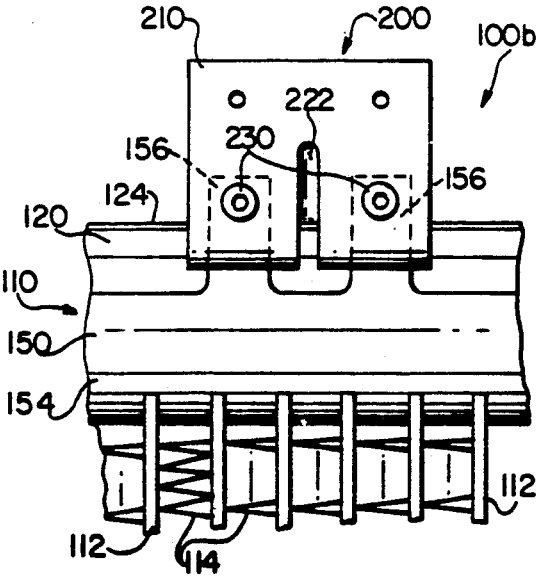
FIG. 7 is a partial side elevational view of the manifold and heat exchanger assembly of FIG. 5, showing the attachment of the bracket to the header plate.

Referring now to FIGS. 1-4, there is shown a first embodiment of a manifold and heat exchanger assembly 100*a* in accordance with the present invention. Manifold and heat exchanger assembly 100*a* comprises a manifold assembly 110 into which are inserted a plurality of parallel condenser or evaporator tubes 112. Fins 114 can be provided in a conventional manner as shown in FIGS. 5 and 7.

Manifold assembly 110 comprises a unitary tank 120 having a semi-circular cross-section and a unitary header plate 150 also having a semi-circular cross-section. Thus, the interior of manifold assembly 110 has a substantially circular cross-section, allowing it to withstand higher internal pressures than D-shaped manifold assemblies.

Tank 120 comprises an inner wall 122, an outer wall 124, and a pair of longitudinal lower edges 130 extending between inner and outer walls 122 and 124.

Header plate 150 has a length substantially equal to the length of tank 120 and comprises an inner wall 152, an outer wall 154 substantially parallel to inner wall 152, and a pair of longitudinal upper edges 160 extending between inner and outer walls 152 and 154. The inner diameter of header plate 150 is substantially equal to the outer diameter of tank 120 to allow tank 120 to be inserted into header plate 150.

A plurality of transverse tube holes 170 (FIG. 3) are formed through header plate 150 along its longitudinal center line for receiving tubes 112 of manifold and heat exchanger assembly 100*a*. Flanges or lips 172 are formed around tube holes 170. Flanges 172 are very uniform formed sections which follow the internal contour of header plate 150, i.e. the contour in inner wall 152, thereby providing both a tube lead-in and a joint filleting pocket.

In the first embodiment of manifold assembly 110 according to the invention, tank 120 preferably is formed by extrusion and header plate 150 preferably is formed by stamping. Tank 120 can be extruded from an aluminum alloy such as AA3003 or the like, while header plate 150 is fabricated from sheet aluminum of a desired base aluminum alloy such as AA3003 or the like, clad on both surfaces with aluminum alloy such as 4004, or other suitable brazing alloys.

A plurality of opposed transverse slots 180 having parallel planar walls 182 (FIGS. 1 and 4) are formed through tank 120 and header plate 150 along their longitudinal center lines to receive baffles 190 therein for locking tank 120 and header plate 150 together during assembly and for adjusting the flow pattern during use. Baffles 190 are configured to form a tight fit with inner wall 122 of tank 120 and inner wall 152 of header plate 150, and inner walls 182 of slots 180, and to extend outwardly of outer wall 124 of tank 120 and outer wall 154 of header plate 150.

Figure 4:
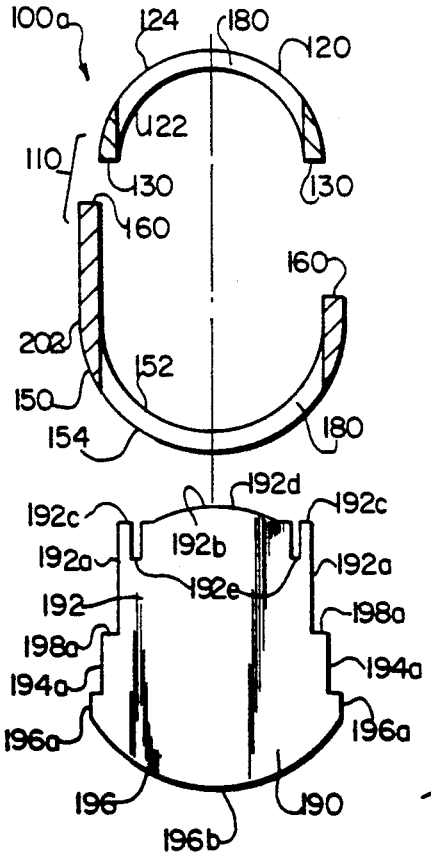
FIG. 4 is a cross-sectional view of the manifold and heat exchanger assembly in accordance with the present invention, with the tank, header plate, and baffles unassembled.
Figure 3:
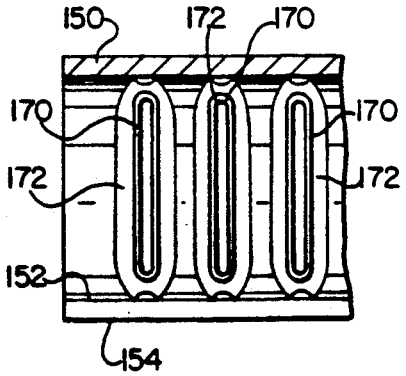
FIG. 3 is a cross-sectional view of the manifold and heat exchanger assembly of FIG. 1, taken along line 3—3 of FIG. 1.
Figure 5:
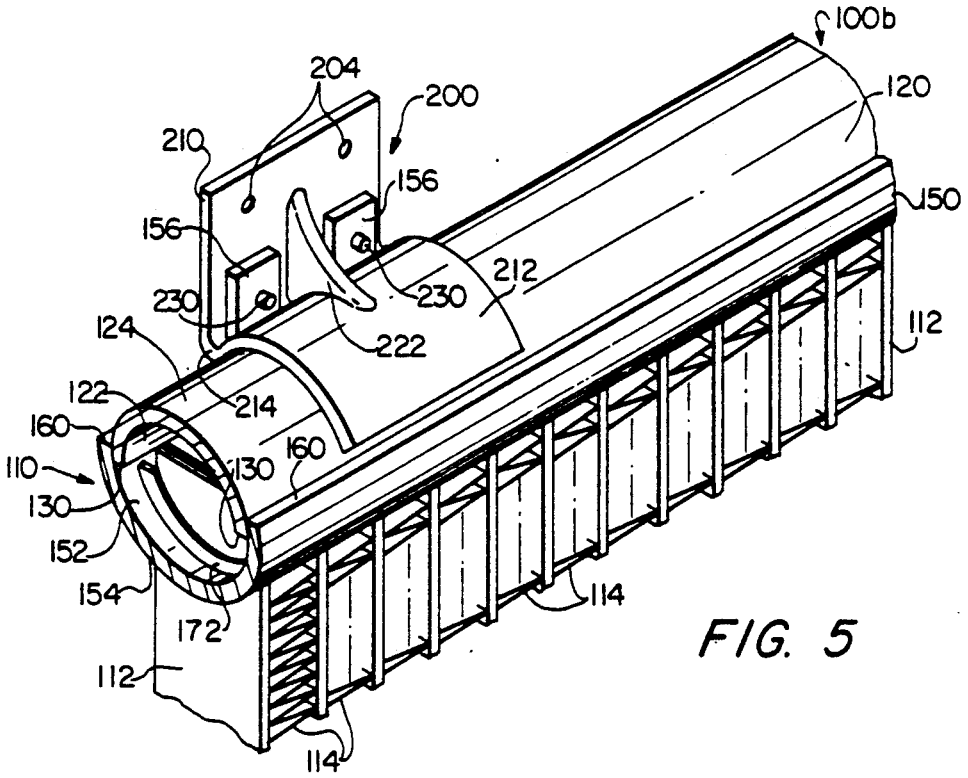
FIG. 5 is a perspective view, partially cut away, of a manifold and heat exchanger assembly in accordance with a second embodiment of the present invention.

As best shown in FIG. 4, baffle 190 comprises a tank or upper portion 192 which is inserted in tank 120, an interior header or lower portion 194 which is inserted in header plate 150, and an exterior header or lower portion 196 which extends outwardly of outer wall 154 of header 150. Tank portion 192 has a pair of opposed parallel sides **192*a* which are substantially planar and an upper edge 192*b* which extends upwardly of outer wall 124 of tank 120. Upper edge 192*b* has a pair of planar outer portions 192*c*, a convex central portion 192*d*, and a pair of vertical rectangular notches 192*e* intermediate each of outer portions 192*c* and central portion 192*d*. Interior header portion 194 has a pair of opposed parallel sides 194*a* which are substantially planar. Exterior header portion 196 also has a pair of opposed parallel sides 196*a* and a convex lower edge 196*b*. Sides 192*a* are inset from sides 194*a* so as to define a pair of upper shoulders 198*a* which engage lower edges 130 of tank 120 and divide interior header portion 194 from tank portion 192. Further, sides 194*a* are inset from sides 196*a* so as to define a pair of lower shoulders 198*b* which engage outer wall 152 of header 150 and divide exterior header portion 196 from interior header portion 194**.

In manifolds formed from circular or semi-circular tubes as shown in the prior art, internal baffles must be installed from either end or through an external slot as shown in the Hoshino et al. patent. The use of the two-piece construction in accordance with the present invention allows installation of baffles 190 before assembly of tank 120 and header plate 150.

A bracket 200 can be formed unitarily with header plate 150 as, for example, a planar section 202 extending tangentially upward from the semi-circular portion of header plate 150 along one side thereof. Bracket 200 can be used to fasten manifold assembly 110 to another structure, for example by screws (not shown) inserted through holes 204 in bracket 200.

Assembly of tank 120 with baffles 190 and header plate 150 can also be accomplished as a unit prior to assembly of manifold assembly 110 to tubes 112. Where, in certain brazing operations it is desired to use flux, the flux can be applied to the mating surfaces of the parts before their assembly. The prior art makes this operation very difficult.

Only a single manifold assembly is shown assembled to the tubes 120 in the figures. However, it should be understood that in practice, a manifold assembly is assembled to tubes 120 at either end.

Tank 120 preferably is formed by extrusion. Header plate 150 preferably is formed by stamping, but also can be formed by extrusion. Tank 120 can be extruded from an aluminum alloy such as AA3003 or the like, while header plate 150 is fabricated from sheet aluminum of a desired base aluminum alloy such as AA3003 or the like, clad on both surfaces with aluminum alloy such as 4004, or other suitable brazing alloys.

In general, as described above tank 120, header plate 150, and baffles 190 in accordance with the first embodiment of the invention are formed of aluminum and aluminum alloy materials suitable for brazing, at least one of the mating surfaces being fabricated with a lower temperature clad brazing material. For example, a lower cost extruded alloy can be used for tank 120, while a clad brazing sheet can be used for header plate 150. Thus, when tank 120, header plate 150, baffles 190, and tubes 112 are assembled, fixtured in place, and brazed in a high temperature brazing furnace, the clad material on header plate 150 provides the brazed material to braze tubes 112 to header plate 150, header plate 150 to tank 120, and baffles 190 to tank 120 and header plate 150.

Figure 6:
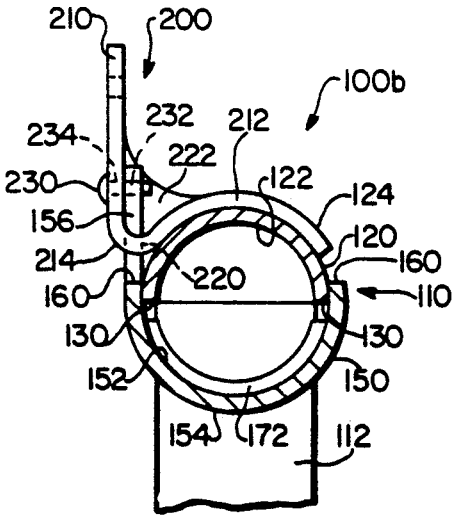
FIG. 6 is a cross-sectional view of the manifold and heat exchanger assembly of FIG. 5, taken along line 6—6 of FIG. 5.

Referring now to FIGS. 5–7, there is shown a second embodiment of a manifold and heat exchanger assembly **100*b* in accordance with the present invention. Manifold and heat exchanger assembly 100*b* is similar in configuration to manifold and heat exchanger 100*a* shown in FIGS. 1–4. However, in the second embodiment, bracket 200 is not formed unitarily with header plate 150. Rather, a pair of spaced-apart attachment tabs 156 are formed unitarily with header plate 150 as tangential upward extensions from one of upper edges 160. Bracket 200** is provided as a separate piece.

Bracket 200 comprises a first planar portion 210 which bears against tabs 156, a second curved portion 212 for matingly engaging upper wall 124 of tank 120, and an intermediate portion 214 intermediate planar portion 210 and curved portion 212 having spaced-apart slots 220 therein for receiving tabs 156 therethrough. A hollow vertical rib 222 is formed along the center line of bracket 200.

Bracket 200 is mechanically fastened to manifold assembly 110 by nickel plated or stainless steel screws 230 inserted through holes 232 in tabs 156 (FIG. 6) and holes 234 in bracket 200 (FIG. 6). A metallurgical bond is also formed between bracket 200 and tabs 156, and between bracket 200 and upper wall 124 of tank 120 after assembly when manifold assembly 110 is brazed in the brazing furnace. The location of bracket 200 can be varied by varying the locations of tabs 156 on header plate 150. Bracket 200 can be used to fasten manifold assembly 110 to another structure, for example by screws (not shown) inserted through holes 204 in planar portion 210.

In accordance with the second embodiment of the invention, tank 120, header plate 150, and bracket 200 are all formed of clad aluminum brazing sheet as described above with respect to header plate 150 of the first embodiment of the invention. Alternatively, the aluminum brazing sheet from which header plate 150 and bracket 200 are formed is clad, but that from which tank 120 is formed is not clad. As brazing sheet cannot be extruded, tank 120, header plate 150, and bracket 200 are formed by conventional forming or stamping methods. The use of brazing sheet for tank 120 reduces the assembly weight and increases the braze line or brazed joints between the parts.

From the above, it is apparent that many modifications and variations of the present invention are possible in light of the above teachings. It is therefore to be understood that, within the scope of the appended claims, the invention may be practiced otherwise than as specifically described.

WHAT IS CLAIMED IS:

1. A manifold assembly for use with an internal pressure heat exchanger comprising a plurality of parallel tubes, said manifold assembly comprising:

a unitary tank having a semi-circular cross-section, said tank comprising an inner wall, an outer wall, and a pair of longitudinal lower edges intermediate said inner and outer walls; and a unitary header plate having a semi-circular cross-section and a length substantially equal to the length of said tank, said header plate comprising an inner wall, an outer wall, and a pair of longitudinal upper edges intermediate said inner and outer walls, said header plate having an inner diameter substantially equal to the outer diameter of said tank, and said header plate having a plurality of transverse tube holes formed therethrough for receiving the tubes of the heat exchanger;

said lower edges of said tank being inserted in said header plate;

said header plate and said tank being brazed together along substantially the entire lengths of their mating surfaces; and said tank and said header plate being formed of aluminum and aluminum alloy materials suitable for furnace brazing, at least one of the mating surfaces being fabricated with a lower temperature clad brazing material.

2. The manifold assembly of claim 1, further comprising a bracket formed unitarily with said header plate.

3. The manifold assembly of claim 2, wherein said bracket comprises a planar section extending tangentially upward along one side of said header plate.

4. The manifold assembly of claim 1, further comprising a bracket attached to said tank and to said header plate.

5. The manifold assembly of claim 4, wherein said header plate further comprises attachment means formed unitarily therewith for attaching said bracket to said header plate.

6. The manifold assembly of claim 4, wherein said attachment means is formed as a tangential upward extension from one of said upper edges of said header plate.

7. The manifold assembly of claim 6, wherein said bracket comprises a first planar portion which bears against said attachment means, a second curved portion for matingly engaging said outer wall of said tank, and an intermediate portion having slot means therein for receiving said attachment means therethrough.

8. The manifold assembly of claim 1, wherein said header plate further comprises flanges formed around said tube holes, said flanges following the internal contour of said inner wall of said header plate.

9. The manifold assembly of claim 1, wherein said tank and said header plate have formed therethrough a plurality of opposed transverse slots along their longitudinal center lines, and wherein said manifold assembly further comprises a plurality of baffles received in said slots.

* * * * *